US005460158A

United States Patent [19]

Rigaud; André

[11] Patent Number: 5,460,158

[45] Date of Patent: Oct. 24, 1995

[54] GAS-FIRED DIRECT HEAT STEAM OVEN

[75] Inventor: AndréRigaud, Faverges, France

[73] Assignee: Societe Cooperative de Production Bourgeois, Faverges, France

[21] Appl. No.: 186,765

[22] Filed: Jan. 25, 1994

[30] Foreign Application Priority Data

Jan. 29, 1993 [FR] France ..... 93 01123

[51] Int. Cl.[6] ..... A21B 1/24; A21B 1/28; F24C 15/32

[52] U.S. Cl. ..... 126/21 A; 126/20; 126/20.1

[58] Field of Search ..... 126/20, 21 A, 126/20.1, 20.2, 19 R

[56] References Cited

U.S. PATENT DOCUMENTS

| | | | |
|---|---|---|---|
| 4,813,398 | 3/1989 | Savage . | |
| 4,823,766 | 4/1989 | Violi . | |
| 4,926,837 | 5/1990 | Parker et al. | 126/21 A |
| 5,016,605 | 5/1991 | LaForet et al. . | |
| 5,309,981 | 5/1994 | Binder | 126/21 A X |

FOREIGN PATENT DOCUMENTS

| | | | |
|---|---|---|---|
| 0087726 | 7/1981 | Japan | 126/21 A |

OTHER PUBLICATIONS

Patent Abstract of Japan vol. 005, No. 158 (M091) 12 Oct. 1981 JP56085641 (Matsushita) 11 Jul. 1981.

*Primary Examiner*—Carl D. Price
*Attorney, Agent, or Firm*—Ratner & Prestia

[57] ABSTRACT

An oven comprises an enclosure in which an intermediate wall separates a first part for containing materials to be cooked from a second part containing the functional units of the oven and in particular a fan and a burner. The burner is on the downstream side of the fan in the direction of the flow of air caused by the fan and the flame that it produces is oriented transversely to the direction of air flow. The burner outlet orifices are oriented to allow any water condensing in the burner to drain out by gravity. The intermediate wall is removable for cleaning. This maximizes the volume of the first enclosure part and considerably facilitates cleaning of the functional units of the oven, without disturbance to the operation of the burner.

8 Claims, 2 Drawing Sheets

GAS-FIRED DIRECT HEAT STEAM OVEN

BACKGROUND OF THE INVENTION

1. Field of the invention

The present invention concerns gas-fired direct heat steam ovens, in particular ovens for cooking food products.

2. Description of the Prior Art

Combined steam and gas ovens are described in documents EP-A-0 277 888 (U.S. Pat. No. 4,823,766) and EP-A-0 409 685 (U.S. Pat. No. 5,016,605), for example.

A gas-fired direct heating and convection oven of this known kind essentially comprises an enclosure enclosed by a peripheral wall and a door, the interior space of the enclosure comprising a first part receiving food products to be cooked and a second part containing at least one gas burner connected to a system supplying a mixture of gas and pressurized combustion-supporting air and at least one fan for circulating hot air through both parts of the enclosure.

Various solutions have been proposed for the problem of preventing water forming and stagnating in the gas burner due to condensation of the steam. In document EP-A-0 277 888 the gas burner is on the downstream side of the fan in the flow of air caused by the fan and is in the lower part of the enclosure, the flame outlet orifices being directed upwards. Auxiliary heating means maintain the burner at all times at a temperature higher than the temperature at which water vapor condenses, so preventing the formation of liquid water in or on the burner. A solution of this kind is not satisfactory, however, and in particular causes significant disturbance of the flame.

In document EP-A-0 409 685 the gas burner is on the upstream side of the fan in the flow of air caused by the fan and in an intermediate part of the enclosure between a first partition wall separating it from the part containing the food to be cooked and a second partition wall separating it from the part occupied by the fan. The burner is in an upper part of the enclosure and oriented to direct the flame downwards, favoring the draining off of any water formed by condensation in the burner. This solution substantially increases the overall size of the functional units of the oven, so reducing the volume of the part for receiving the foods to be cooked. Furthermore, cleaning the various functional units entails demounting two successive walls and this is particularly difficult because of the presence of various sensors associated with the burner for monitoring or controlling the gas flame.

The problem to which the present invention is addressed is that of designing a new gas-fired direct heating steam oven in which all the functional units such as the fan and the burner are included in a single enclosure part in order to occupy a small space, a single wall separating this enclosure part from the part to receive the foods to be cooked, and in which means are provided to prevent the accumulation of condensed water in the burner and to favor the stabilization and the continuity of the gas flame.

Another object of the invention is to facilitate significantly the cleaning of the functional units of the oven and to reduce the risk of damage to these functional units during cleaning.

The invention also enables better distribution of the flame in the burners, improving combustion and the distribution of heat.

SUMMARY OF THE INVENTION

The present invention consists in a gas-fired direct heating and convection oven suitable for cooking food products comprising an enclosure enclosed by a peripheral wall and a door, the interior space of said enclosure being divided by an intermediate wall having air inlet and outlet openings into a first part for receiving food products to be cooked and a second part containing at least one gas burner connected to a system for supplying a mixture of gas and pressurized combustion-supporting air and at least one fan for circulating heated air in both parts of the enclosure, said gas burner being on the downstream side of said fan in the flow of air caused by said fan, a steam generator being provided for introducing steam into said enclosure, in which oven the outlet orifices of said gas burner are oriented so that any water condensing in said burner can drain out of said burner by gravity through said outlet orifices and so that the burning gas forming the flame flows in a direction forming with the direction of the flow of air from said fan an angle of orientation which is less than a maximal limiting value causing separation of said flame. This angle of orientation is advantageously less than about 90°.

In one embodiment the oven comprises a single fan in a substantially central position near the back wall of said oven and a tubular gas burner above said fan in a substantially horizontal orientation, said burner outlet orifices being directed to the front towards said intermediate wall.

In another embodiment the oven comprises two fans disposed one above the other along the back wall of the oven and two tubular gas burners above respective fans in a substantially horizontal orientation, said burner outlet orifices being oriented to the front towards said intermediate wall.

Other objects, features and advantages of the present invention emerge from the following description of specific embodiments of the invention given with reference to the accompanying drawings.

DETAILED DESCRIPTION OF THE PREFERRED EMBODIMENTS

Figure 1:
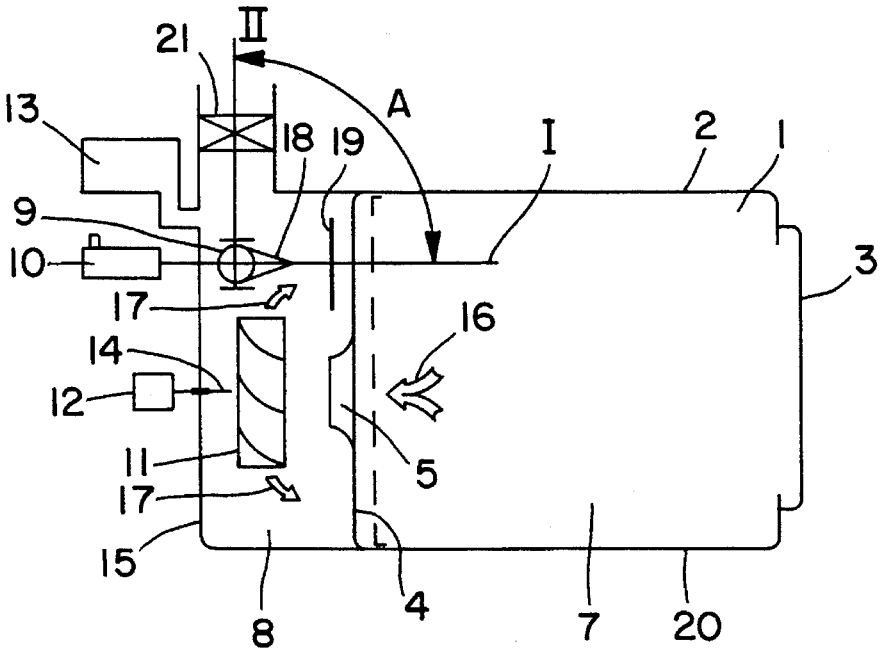
FIG. 1 is a diagrammatic side view in longitudinal cross-section of an oven in accordance with the present invention.
Figure 2:
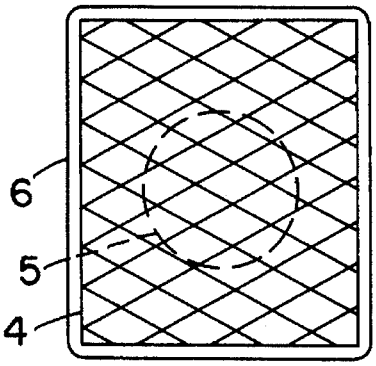
FIG. 2 is a front view of the oven from FIG. 1 with the door open showing the separator wall.
Figure 3:
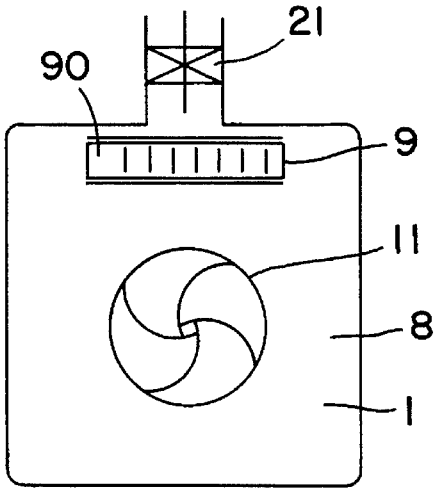
FIG. 3 is a front view of the same oven from FIG. 1 with the door open and the separator wall removed.
Figure 4:
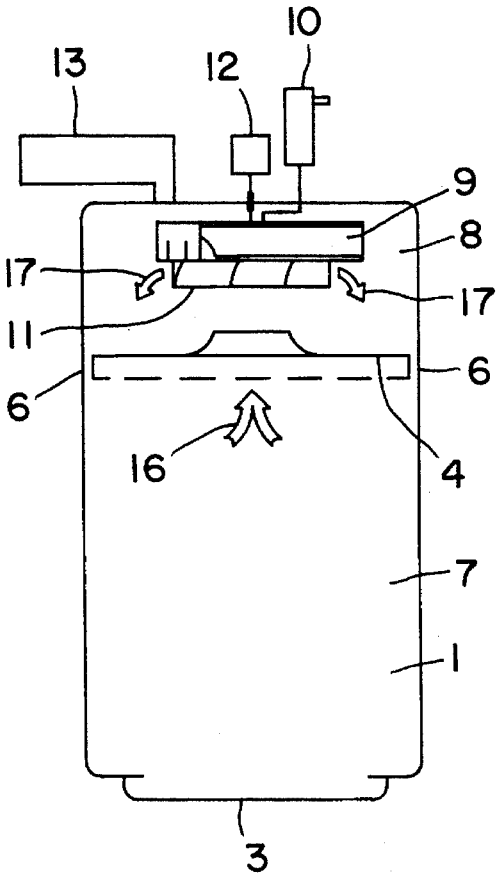
FIG. 4 is a plan view of the oven from FIG. 1 in cross-section.

Referring to the figures, the oven in accordance with the invention comprises an enclosure 1 enclosed by a peripheral wall 2 and a door 3 at the front. The interior space of the enclosure 1 is divided by an intermediate wall 4 incorporating air inlet openings 5 and air outlet openings 6 into a first part 7 receiving food products to be cooked and a second part 8 containing the functional units of the oven. The second part 8 contains a gas burner 9 connected to a system 10 for supplying a mixture of gas and pressurized combustion-supporting air and a fan 11 for circulating heated air through both parts of the enclosure. The fan 11 is driven by an electric motor 12. A steam generator 13 is provided for introducing steam into the enclosure 1 as shown diagrammatically in the figures. The fan 11 rotates about a front-to-back axis 14 perpendicular to the back wall 15 of the oven. The fan 11 is of the axial suction type, as shown by the arrows 16, and discharges the air radially as shown by the arrows 17.

In the embodiment shown the burner 9 is in the upper portion of the second enclosure part 8 above the fan 11. It is therefore on the downstream side of the fan 11 in the flow of air caused by the fan. The burner 9 is generally tubular with its axis substantially horizontal and parallel to the back wall 15 of the oven. It comprises gas outlet orifices 90 oriented so that the flow of burning gas forming the flame 18 is directed to the front towards the intermediate wall 4, i.e. perpendicularly to the flow of air propelled by the fan 11 into the second enclosure part 8. The burner 9 may be oriented differently and its orientation may be chosen in a range of variations such that the direction I of the flow of gas forming the flame 18 forms with the direction II of the flow of air near the burner 9 an angle of orientation which is less than a maximal limiting value causing detachment of the flame 18 due to the action of the flow of air. This angle of orientation is advantageously less than about 90°.

Also, the burner 9 is oriented so that any water condensed in the burner can drain out by gravity through the burner outlet orifices 90.

Various positions of the burner are therefore feasible within the scope of the invention. In the embodiment shown the flame 18 is directed to the front, towards the intermediate wall 4, which may then advantageously be covered with a thermal protection plate 19.

Alternatively, the flame 18 may be directed to the rear towards the back wall 15. The flame 18 must not be directed upwards, as in this case the burner outlet orifices 90 do not allow water to drain out of the burner by gravity.

Alternatively, the burner could be placed in the lower portion of the second enclosure part 8, under the fan 11. The flame could then be directed either to the front towards the intermediate wall 4 or to the rear towards the back wall 15, or even towards the bottom 20 of the enclosure, or with any intermediate downward orientation between the orientation to the front and the orientation to the rear.

Other embodiments are feasible, with one or more burners at the sides of the fan, with the tube forming the burner oriented vertically. Water could then drain out of the burner through the bottom outlet orifice of the burner.

The structure of the burner 9 itself is advantageously tubular and may be similar to that described in document EP-A-0 409 685, with a series of slots distributed along the length of the tube, substantially perpendicular to the axis of the tube and open over slightly less than half the circumference of the tube. A tube of this kind is advantageously associated with deflector plates parallel to the axis of the tube and flanking the ends of the outlet slots.

A tube of this kind is connected to a gas and air mixture feed pipe. According to the invention the pipe advantageously terminates at a central position on the burner at equal distances from both ends. This improves the distribution of the gas and produces a more regular flame along the burner.

An outlet 21 for burnt gases is provided in the known manner at the top of the second enclosure part 8.

In the embodiment shown the intermediate wall 4 has air inlet openings 5 facing the fan 11 to filter the air entering the fan axially as shown by the arrows 16. The intermediate wall 4 further comprises air outlet openings 6 where it joins to the peripheral enclosure wall, preferably near where the intermediate wall 4 joins the side walls of the oven.

The intermediate wall 4 is advantageously removable, being taken out of the enclosure 1 through the door 3. It can be removed to clean the functional units housed in the second enclosure part 8. All the functional units of the oven are contained in the same enclosure part 8. To clean them the intermediate wall 4 is simply removed. This considerably facilitates the cleaning operation. In particular, removing the intermediate wall 4, which lies entirely to the front of all the functional units, eliminates the risk of damaging the functional units and in particular the sensors associated with the burner 9 in the known manner to detect and control the flame 18.

In the embodiment of FIGS. 1 through 4 the oven comprises a single fan 11 in a substantially central position near the back wall 15 of the oven and a tubular gas burner 9 in a substantially horizontal orientation above the fan 11, the flame being oriented to the front towards the intermediate wall 4.

Figure 5:
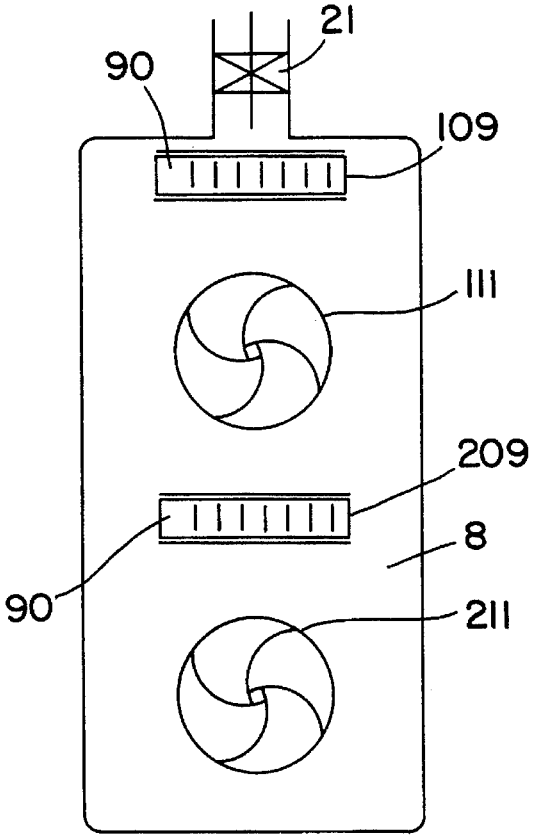
FIG. 5 is a front view of a second embodiment of an oven in accordance with the invention with the door open and the intermediate wall removed.

In the embodiment of FIG. 5, which shows the oven open with the intermediate wall 4 removed, the oven comprises two fans 111 and 211 disposed one above the other along the back wall of the oven and two tubular gas burners 109 and 209 placed above respective fans in a substantially horizontal orientation, the burner outlet orifices 90 being oriented to the front towards the intermediate wall.

The present invention is not limited to the embodiments specifically described but encompasses all variants and generalizations thereof within the scope of the following claims.

There is claimed:

1. Gas-fired direct heating and convection oven suitable for cooking food products comprising an enclosure with an interior space enclosed by a peripheral wall and a door coupled to the peripheral wall, the interior space of said enclosure being divided by an intermediate wall having an air inlet opening and air outlet openings, said intermediate wall dividing said enclosure into a first enclosure part for receiving food products to be cooked and a second enclosure part containing at least one gas burner having outlet orifices and being connected to a system for supplying a mixture of gas and pressurized combustion-supporting air and at least one fan with a downstream side for circulating heated air in both parts of the enclosure, said air inlet opening and said air outlet openings providing communication of said heated air between said first enclosure part and said second enclosure part, said gas burner being on the downstream side of said fan in the flow of air caused by said fan, a steam generator being provided for introducing steam into said enclosure, in which the outlet orifices of said gas burner are oriented so that any water condensing in said burner can drain out of said burner by gravity through said outlet orifices and so that a flame formed by the burning gas flows in a direction forming an angle of orientation which is less than 90° with the direction of the flow of air from said fan.

2. The oven according to claim 1 wherein said enclosure has a front-to-back axis and wherein said fan rotates about said front-to-back axis and said intermediate wall comprises said air inlet opening facing said fan for axial entry of air and said air outlet openings near where said intermediate wall joins said peripheral wall of said enclosure.

3. The oven according to claim 2 comprising a single fan in a substantially central position near a back wall of said oven and a tubular gas burner above said fan in a substantially horizontal orientation, said burner outlet orifices being directed to the front of the enclosure towards said intermediate wall.

4. The oven according to claim 2 comprising two fans disposed one above the other along a back wall of the oven and two tubular gas burners located above respective fans in a substantially horizontal orientation, said burner outlet orifices being orientated to the front of the enclosure towards said intermediate wall.

5. The oven according to claim 3 wherein said air outlet openings are formed near where said intermediate wall joins the peripheral wall of the oven.

6. The oven according to claim 4 wherein said air outlet openings are formed near where said intermediate wall joins the peripheral wall of the oven.

7. The oven according to claim 1 wherein said intermediate wall is removable for cleaning functional units in said second enclosure part.

8. The oven according to claim 1 wherein said intermediate wall is covered with a thermal protection plate in line with said at least one gas burner.

* * * * *